United States Patent [19]

Suzuki et al.

[11] Patent Number: 4,846,632

[45] Date of Patent: Jul. 11, 1989

[54] VARIABLE DISPLACEMENT VANE COMPRESSOR

[75] Inventors: Shigeru Suzuki; Katsuhiko Ohshiro; Yasushi Watanabe, all of Kariya, Japan

[73] Assignee: Kabushiki Kaisha Toyoda Jidoshokki Seisakusho, Aichi, Japan

[21] Appl. No.: 304,877

[22] Filed: Jan. 30, 1989

Related U.S. Application Data

[63] Continuation of Ser. No. 902,311, Aug. 29, 1986, abandoned.

[30] Foreign Application Priority Data

Sep. 2, 1985 [JP] Japan ..... 60-193328

[51] Int. Cl.[4] ..... F04B 49/02; F04C 29/08

[52] U.S. Cl. ..... 417/295; 417/310; 62/228.5

[58] Field of Search ..... 62/228.5, 217; 417/440, 417/295, 299, 310; 418/78, 85

[56] References Cited

U.S. PATENT DOCUMENTS

| | | | |
|---|---|---|---|
| 3,451,614 | 6/1969 | Tosh . | |
| 4,060,343 | 11/1977 | Newton | 417/309 |
| 4,137,018 | 1/1979 | Brucken . | |
| 4,272,227 | 6/1981 | Woodruff | 418/185 |
| 4,557,670 | 12/1985 | Inagaki | 417/299 |
| 4,726,740 | 2/1988 | Suzuki et al. | 417/298 |

FOREIGN PATENT DOCUMENTS

| | | |
|---|---|---|
| 2057750 | 11/1970 | Fed. Rep. of Germany . |
| 1066760 | 11/1952 | France . |
| 814178 | 10/1955 | United Kingdom . |
| 811557 | 9/1957 | United Kingdom . |

OTHER PUBLICATIONS

Patent Abstracts of Japan, vol. 7, No. 59 (M-199) [1204], Mar. 11, 1983; & JP-A-57 203 892 (Nippon Denso K.K.).

Patent Abstracts of Japan, vol. 7, No. 240 (M-251) [1385], Oct. 25, 1983; & JP-A-58 128 487 (Nippon Jidosha Buhin Sogo Kendyusho K.K.).

*Primary Examiner*—William J. Freeh

*Attorney, Agent, or Firm*—Burgess, Ryan & Wayne

[57] ABSTRACT

A variable displacement vane compressor for an air conditioning system used in an automobile has a cylinder assembly having a bore which receives a rotor to form at least one crescent or compressing chamber between the rotor and the bore. The crescent chamber receives a refrigerant which is returned from the air conditioning system. The rotor has vanes which are extendably fitted therein so that the free end of the vanes are in contact with the circumferential inner surface of the bore during the rotation of the rotor, whereby when the vane passes through the crescent chamber, the refrigerant received therein can be compressed. The amount of the refrigerant introduced into the crescent chamber is adjustable in response to a change of a cooling load at the air conditioning system.

4 Claims, 7 Drawing Sheets

VARIABLE DISPLACEMENT VANE COMPRESSOR

This application is a continuation of application Ser. No. 902,311, filed Aug. 29, 1986, now abandoned.

BACKGROUND OF THE INVENTION (1) Field of the Invention

The present invention relates to a rotary vane compressor for an air conditioning system used in a vehicle such as an automobile, and more particularly, relates to a variable displacement vane compressor which comprises a cylinder assembly including a cylindrical body having a bore and opposed end wall members secured to the opposed ends of the cylindrical body, respectively, for closing open ends of the bore, and a rotor disposed within the bore for rotation so as to form at least one crescent chamber between the rotor and the bore of the cylinder assembly for receiving a refrigerant, the rotor having at least one vane which is extendably fitted in the rotor so that the free end of the vane is in contact with the circumferential inner wall surface of the bore during the rotation of the rotor, whereby when the vane passes through the crescent chamber, the refrigerant is capable of being compressed, wherein an amount of the refrigerant which is introduced into the crescent chamber is adjustable in response to a change of a cooling load at the air conditioning system.

(2) Description of the Related Art

Conventionally, a variable displacement vane compressor used in an air conditioning system for a vehicle such as an automobile, is driven by the motor of the automobile, and the room temperature of the automobile is adjustable to a temperature at which a driver and passengers feel comfortable under ambient conditions. When a cooling load which the air conditioning system must bear becomes very high, the compressor must be run at the maximum cooling capacity thereof, whereas when the cooling load becomes lower, the compressor must be run at a lower cooling capacity. When the room temperature once reaches a comfortable temperature, preferably the compressor is run at the smallest cooling capacity at which the comfortable temperature can be maintained.

Japanese Unexamined Patent Publication No. 59-99089, filed by the same applicant, discloses a variable displacement vane compressor wherein an amount of the refrigerant, which is introduced into the crescent chamber, is adjustable in response to a pressure change of the refrigerant which is returned from the evaporator of the air conditioning system to the compressor. Particularly, the compressor is constructed so that an opening area for introducing the refrigerant from a suction chamber of the compressor, which is connected to the evaporator of the air conditioning system, into the crescent chamber can be throttled in response to a pressure change of the refrigerant within the suction chamber. When the air conditioning system is under a high cooling load, a large amount of the refrigerant is evaporated in the evaporator and the pressure of the refrigerant is increased within the suction chamber. Accordingly, in the compressor, as the pressure of the refrigerant is further increased in the suction chamber, the opening area is made larger so that a larger amount of the refrigerant is introduced from the suction chamber into the crescent or compressing chamber, whereby the compressor can be run at a higher cooling capacity. Conversely, when the air conditioning system is under a low cooling load, the refrigerant pressure of the suction chamber is further lowered. In this case, the throttling of the opening area for introducing the refrigerant from the suction chamber into the compressing chamber is increased so that a smaller amount of the refrigerant is introduced from the suction chamber into the compressing chamber, whereby the compressor is run at a lower cooling capacity.

This conventional compressor can be run at a high operation speed, because the best throttling effect of the opening area can be obtained only at such a high operation speed. In other words, at a low speed operation, it is impossible to obtain the optimum throttling effect of the opening area. This is because although the opening area is throttled and made small, a relatively large amount of the refrigerant may be introduced from the suction chamber into the compressing chamber due to the low speed operation, and thus the compressor cannot operate at optimal efficiency at the low cooling capacity under the low speed operation. The running or operation speed of the compressor depends upon the engine speed of an automobile. When the automobile is driven at a low speed, the compressor must run at a low operation speed. Under this circumstance, if the compressor is required to be run at a low cooling capacity, it is impossible to meet this requirement for the reasons mentioned above.

The same inventors have proposed a variable displacement vane compressor wherein a compression stroke which is carried out by the vane is adjustable in response to a pressure change of the refrigerant within the suction chamber of the compressor, whereby an amount of the compressed refrigerant which is discharged from the compressor into the air conditioning system can be varied in response to a change of a cooling load at the air conditioning system. Particularly, this compressor includes an annular plate member which is rotatably disposed between one of the end wall members of the cylinder assembly and the cylindrical body thereof. The annular plate member has an arcuate slot formed therein which is extended in a direction of rotation of the vane and which opens into the crescent or compressing chamber. The vane passes through the crescent chamber in such a manner that it divides the crescent chamber into a front section and rear section, with a volume of the front section being gradually decreased while a volume of the rear section is gradually increased. While the vane advances along the arcuate slot of the annular plate member, a part of the refrigerant received in the front section is allowed to escape into the rear section through the arcuate slot. Thus, a compression stroke which is carried out by the vane starts just after the vane passes through the arcuate slot of the annular plate member. With this arrangement, it is possible to adjust the compression stroke by moving the annular plate member having the arcuate slot in a direction of rotation of the vane, with the movement of the annular plate member being carried out in response to a pressure change of the refrigerant within the suction chamber of the compressor.

This vane compressor can be run at optimal efficiency only when a speed of operation thereof, which depends upon the engine speed of the automobile, is low. This is because, when the speed of operation is high, a part of the refrigerant received in the front crescent chamber section cannot properly escape into the rear crescent chamber section through the arcuate slot of the annular plate member due to the inertia of the refrigerant gas.

SUMMARY OF THE INVENTION

Accordingly, it is an object of the present invention to provide an improved variable displacement vane compressor wherein a low cooling capacity running can be ensured both at the low speed operation and at the high speed operation.

It is also an object of the present invention to provide an improved variable displacement vane compressor of the above-mentioned type having a compact construction.

It is a further object of the present invention to provide an improved variable displacement vane compressor of the above-mentioned type wherein a load on the engine of an automobile imposed by the air conditioning system can be minimized.

It is a still further object of the present invention to provide an improved displacement vane compressor of the above-mentioned type wherein an initial running of the compressor can be carried out without applying an impact load to the engine of an automobile.

In accordance with the present invention, there is provided a variable displacement vane compressor for an air conditioning system used in a vehicle such as an automobile having a cylinder assembly with a bore, a rotor with at least one vane disposed within said bore for rotation so as to form at least one crescent chamber between the rotor and the bore of the cylinder assembly for receiving a refrigerant, and a suction chamber means for receiving the refrigerant from an evaporator of the air conditioning system so as to introduce it into said crescent chamber wherein when the vane passes through the crescent chamber, the refrigerant received therein is capable of being compressed, which comprises, in combination:

means for throttling an opening area through which the refrigerant is introduced from said suction chamber means into the crescent chamber;

means for varying a compression stroke which is carried out by the vane during the passage thereof through said crescent chamber; and means for selectively allowing a part or a substantial portion of the compressing refrigerant to escape from said crescent chamber into said suction chamber means during the compression stroke of said vane, said throttling means, said varying means and said escaping means being adjustable in response to a change of a cooling load at the air conditioning system.

In accordance with a preferred embodiment of the present invention, there is provided a variable displacement vane compressor for an air conditioning system used in a vehicle such as an automobile, which comprises:

a cylinder assembly including a cylindrical body having a bore and opposed end wall members secured to the opposed ends of said cylindrical body, respectively, for closing open ends of said bore;

a rotor disposed within said bore for rotation so as to form at least a crescent chamber between said rotor and the bore of said cylinder assembly for receiving a refrigerant, said rotor having at least a vane which is extendably fitted in said rotor so that the free end of said vane is in contact with the circumferential inner wall surface of said bore during the rotation of said rotor whereby when said vane is passed through said crescent chamber, the refrigerant received therein is capable of being compressed;

said cylinder assembly having an exit port which opens into said crescent chamber for discharging the compressed refrigerant, said exit port being disposed at one of the narrow ends of said crescent chamber which said vane later meets when it passes through said crescent chamber during the rotation of said rotor;

an annular plate member disposed between one of said end wall members and the associated end portion of said cylindrical body and being partially rotatable between a first and second positions;

a throttle means for adjusting an amount of the refrigerant to be introduced into said crescent chamber in such a manner that as said annular plate member moves toward said second position from said first position, the amount of the refrigerant introduced into said crescent chamber is gradually reduced;

said annular plate member having an elongated arcuate slot which is formed therein in the vicinity of the other of the narrow ends of said crescent chamber and which has a length longer than a width of said vane whereby the compression stroke carried out by said vane is variable because said elongated arcuate slot is movable in a direction of rotation of said rotor, and hence said vane, by rotating said annular plate member between said first and second positions;

said annular plate member also having at least one opening which is formed therein between the one of the narrow ends of said crescent chamber and said elongated arcuate slot, said one of the end wall members having at least one opening which is formed therein so as to cooperate with the opening of said annular plate member in such a manner that when said annular plate member is in said first position, the opening of said annular plate member is in misalignment with the opening of said one of the end wall members to completely close the opening of said circular plate member, that when said annular plate member is in an intermediate position between said first and second positions, the opening of said annular plate member is in partial alignment with the opening of said one of the end wall members to allow a part of the compressed refrigerant to escape from said crescent chamber, and that said circular plate member is in said second position, the opening of said annular plate member is in complete alignment with the opening of the one of said end wall members to obtain a maximum rate of escape of the compressed refrigerant; and a drive means for moving said annular plate member between said first and second positions in response to a change of a cooling load at said air conditioning system.

In a preferred embodiment of the present invention, said annular plate member has two or more separate openings which are formed therein between said one of the narrow ends of said crescent chamber and the elongated arcuate slot of said annular plate member and which open into the opening of said one of the end wall members when the annular plate member is in said second position. In this case, said one of the end wall members has two or more openings which are formed therein which are cooperated with the two or more openings of said annular plate member, respectively, which successively open into the respective openings of the one of said end wall members, and all of which completely open into the respective openings of the ne of said end wall members when said annular plate member is in said second position.

Preferably, said throttle means includes an elongated arcuate slot which is formed in the one of said end wall members and which is in alignment with the elongated arcuate slot of said annular plate member in said first position, with both the elongated arcuate slot of the one of said end wall members and the elongated groove or slot of said circular plate member forming an variable opening area through which the refrigerant is introduced into said crescent chamber.

Preferably, said drive means includes a hydraulic actuator in which the lubricant oil used in said compressor in utilized as a working fluid, said hydraulic actuator being operated in response to a change of pressure of the refrigerant returned from said air conditioning system to said compressor for compression.

BRIEF DESCRIPTION OF THE DRAWINGS

These and other objects of the invention will better understood from the following description, with reference to the accompanying drawings, in which.

DESCRIPTION OF THE PREFERRED EMBODIMENTS

Figure 1:
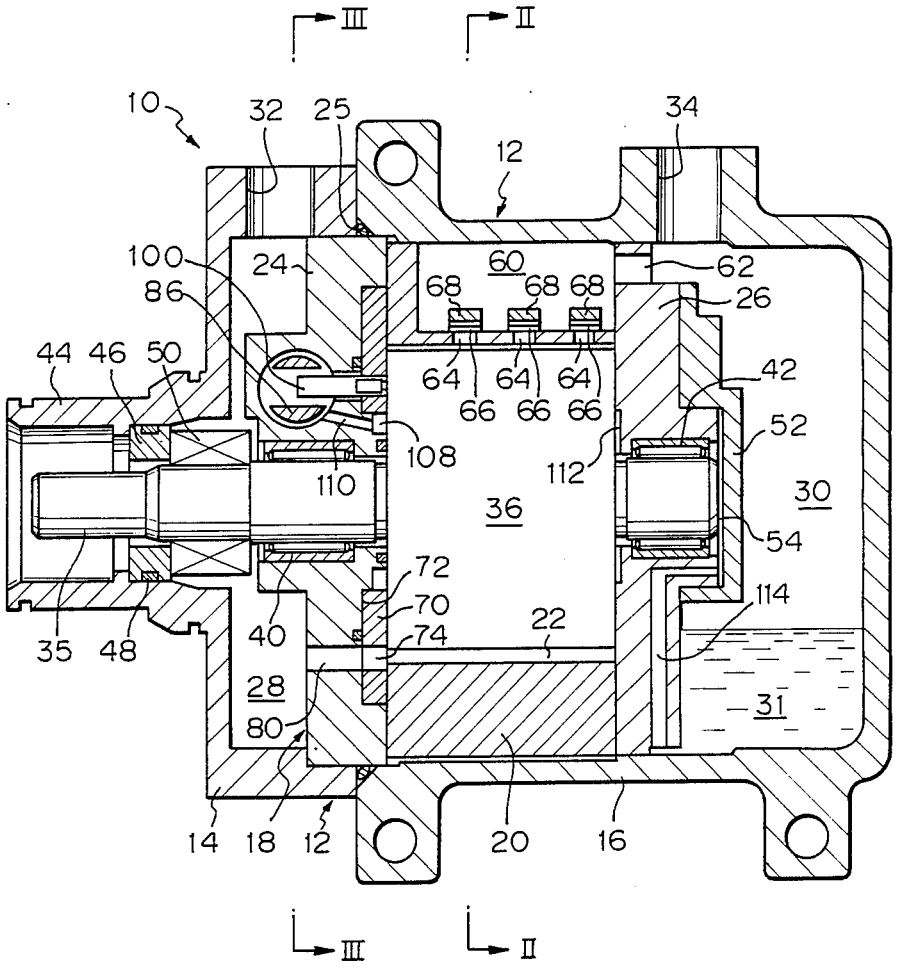
FIG. 1 is a longitudinal sectional view of a variable displacement vane compressor according to the invention.

With reference to FIG. 1, a variable displacement vane compressor according to this invention, which is generally designated by reference numeral 10, comprises a housing 12 which is constructed by coupling two housing parts 14 and 16 together by a suitable clamping means such as bolts and nuts (not shown). The vane compressor 10 also comprises a cylinder assembly, generally designated by reference numeral 18, which is housed within the housing 12.

The cylinder assembly 18 comprises a cylindrical body 20 having a bore 22 and end wall members 24 and 26 secured to the opposed ends of the cylindrical body 20, respectively, for closing the bore 22 at the opening ends thereof. As shown in FIG. 1, the cylindrical assembly 18 is disposed within the housing 12 so that chambers 28 and 30 are defined between the end wall member 24 and the housing part 14 and between the end wall member 26 and the housing part 16, respectively. As seen from FIG. 1, an inner edge of the opening end of the housing part 16 is circumferentially chambered so that a triangular cross sectional annular space is defined between the connected housing parts 14 and 16 and is closed by the peripheral surface of the end wall member 24. Within this annular space, a ring seal 25 is fitted to ensure the airtightness of the housing 12.

The chamber 28, referred to as a suction chamber 28 hereinafter, is adapted to receive a refrigerant from an evaporator (not shown) of an air conditioning system (not shown) through an inlet port 32 formed in the housing part 14. On the other hand, from the chamber 30, referred to as an oil separating chamber hereinafter, a compressed refrigerant is fed to a condenser (not shown) of the air conditioning system through an outlet port 34 formed in the housing part 16. The chamber 30 also serves as a reservoir for receiving a lubricant oil 31 (FIG. 1) with which the movable elements of the vane compressor 10 are lubricated.

Figure 2:
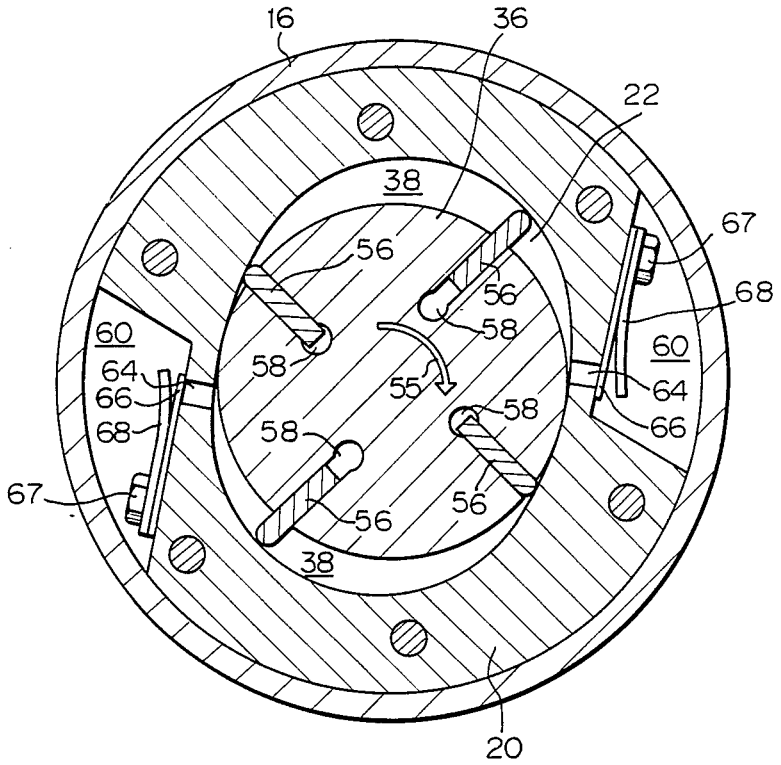
FIG. 2 is a cross sectional view taken along the lines II—II of FIG. 1.

The vane compressor 10 further comprises a rotor 36 which is received within the bore 22 of the cylindrical body 20. In the illustrated embodiment, the bore 22 has an ellipitical cross section so that the rotor 36 can be disposed in the bore to form two crescent chambers 38 therebetween, as best shown in FIG. 2. Alternatively, the bore may have a circular cross section wherein the rotor has a smaller diameter than that of the bore so that a single crescent chamber can be formed within the bore by eccentrically positioning the rotor with respect to the bore.

As seen from FIG. 1, the rotor 36 is mounted on a shaft 35 which is rotatably supported by two needle bearings 40 and 42 provided in the end wall members 24 and 26, respectively. The shaft 35 is extended from the needle bearing 42 of the end wall member 26 through the needle bearing 40 of the end wall member 24 into a sleeve portion 44 which is integrally formed in the housing part 14. An end of the shaft 35, which is extended into the sleeve portion 44, is adapted to be connected to, for example, the engine of an automobile (not shown) through a suitable transmission system.

Also provided are an annular member 46 with a seal ring 48 and a suitable seal assembly 50 to seal an annular clearance between the shaft 35 and the sleeve portion 44, to ensure the airtightness of the suction chamber 28. On the other hand, an end seal cap 52 is attached to the end wall member 26 to cover the exposed end of the shaft 35 which is supported by the needle bearing 42, to prevent the compressed refrigerant from escaping from the chamber 30 through the peripheral clearance around the exposed end of the shaft 35. As shown in FIG. 1, between the bottom surface of the end seal cap 52 and the housing part 26 is formed a space 54, explained in more detail hereinafter.

The rotor 36 is provided with four vanes 56 which are extendably fitted therein so that the free ends of the vanes 56 are in contact with the circumferential inner surface of the bore 22 during rotation of the rotor 36. More particularly, as best shown in FIG. 2, the rotor 36 is provided with four grooves 58 which are formed therein and circumferentially spaced from each other at regular intervals, and the vanes 56 are slidably inserted into the respective grooves 58.

As seen from FIG. 2, each of the grooves 58 has an enlarged portion formed at the bottom end thereof, which forms a lubricant oil passage and which is in communication with the lubricant oil 31 of the reservoir 30 in a manner as stated hereinafter. Since the lubricant oil 31 is pressurized under the compressed refrigerant within the oil separating chamber 30, the vanes 56 have a tendency to be pushed out of the respective grooves 58 due to introduction of the pressurized lubricant oil 31 into the lubricant oil passages of the grooves 58, so that the contact between the free ends of the vanes 56 and the inner surface of the bore 22 can be securely maintained.

As seen from FIGS. 1 and 2, the cylindrical body 20 of the cylinder assembly 18 has two recesses 60, which are formed thereon in such a manner that the material of the cylindrical body 20 is partially cut off therefrom, and which are diametrically disposed around the cylindrical body 22 (FIG. 2). The recesses 60 are closed by the circumferential wall of the housing part 16 and the end wall member 26, as seen from FIG. 1, so as to form a chamber, hereinafter referred to as a discharging chamber. Each of the recesses or discharging chambers 60 is in communication with the oil separating chamber 30 through a hole 62 formed in the end wall member 26.

On the other hand, each of the discharging chambers 60 can be communicated with the corresponding crescent chamber 38 through three exit ports 64 which are formed in the cylindrical body 20 and which are provided with a reed valve 66. The reed valve 66 is secured at one end thereof on the bottom of the recess 60 by means of a screw 67 so that the other end thereof closes the corresponding exit port 64. In order to protect the reed valve 66, a retainer 68 is provided on each of the reed valves 66 and is also secured on the bottom of the recess 60 by the screw 67. As shown in FIG. 2, the two exit ports 64 are disposed at one of the narrow ends of the corresponding crescent chamber 38 which the vanes 56 later meet when passing therethrough during rotation of the rotor 36. A rotating direction of the rotor 36 is indicated by an arrow 55 as shown in FIG. 2.

Figure 5:
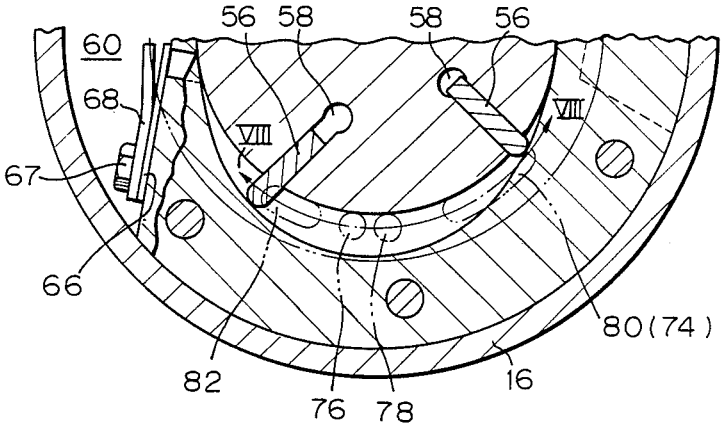
FIG. 5 is a half cross sectional view, which corresponds to FIG. 2, showing a positional relationship between an arcuate slot and openings of an annular plate member and arcuate slots of an end wall member wherein the annular plate member is in a first extreme position thereof.
Figure 7:
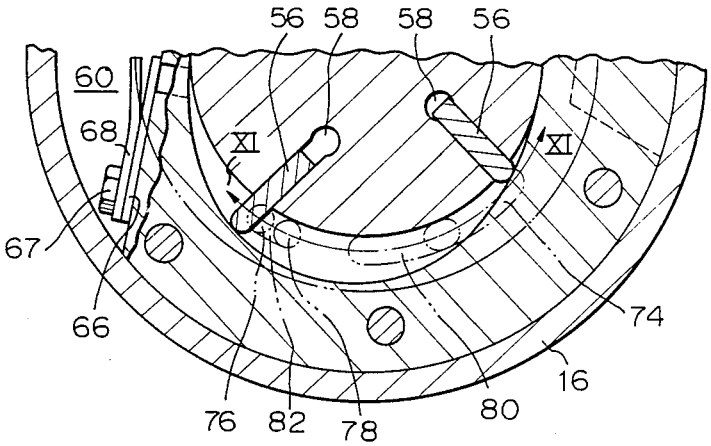
FIG. 7 is a half cross sectional view similar to FIG. 5 wherein the annular plate member is in the second extreme position thereof.
Figure 8:
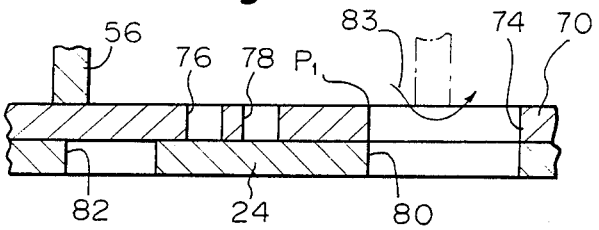
FIG. 8 is a sectional view taken along the lines VIII—VIII of FIG. 5.
Figure 11:
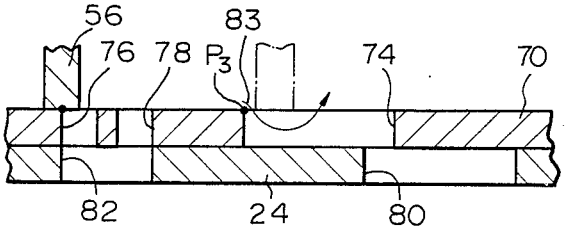
FIG. 11 is a sectional view taken along the lines XI—XI of FIG. 7.
Figure 12:
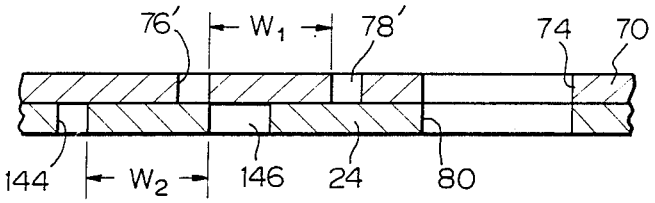
FIGS. 12 through 15 are sectional views showing another embodiment of the invention, which correspond to FIGS. 8 to 11, respectively.
Figure 13:
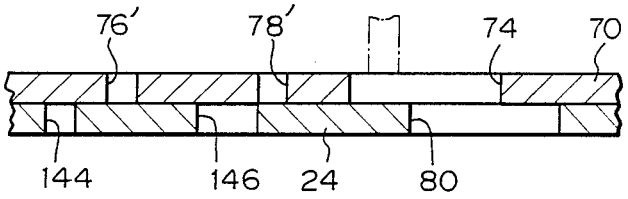
Figure 14:
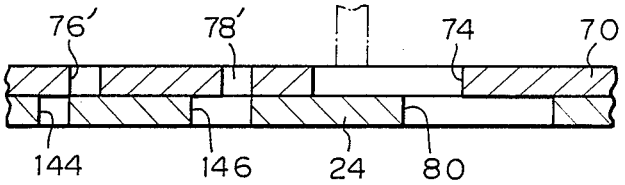
Figure 15:
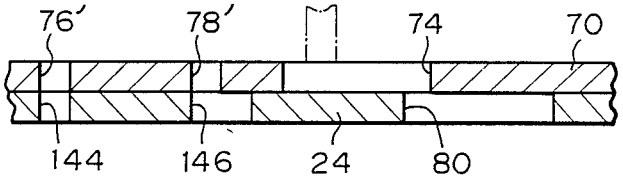

The vane compressor 10 further comprises an annular plate member 70 which is rotatably provided between the end wall member 24 and the cylindrical body 20. To this end, an annular recess 72 for receiving the annular plate member 70 is formed in the face of the end wall member 24 which is in contact with the corresponding end face of the cylindrical body 20 when coupled thereto. The annular recess 72 is dimensionally shaped so that the outer surface of the annular plate member is flush with the face of the end wall member 24. The annular plate member 70 can be rotated within the annular recess 72 between a first position as shown in FIGS. 5 and 8 and a second position as shown in FIGS. 7 and 11.

Figure 3:
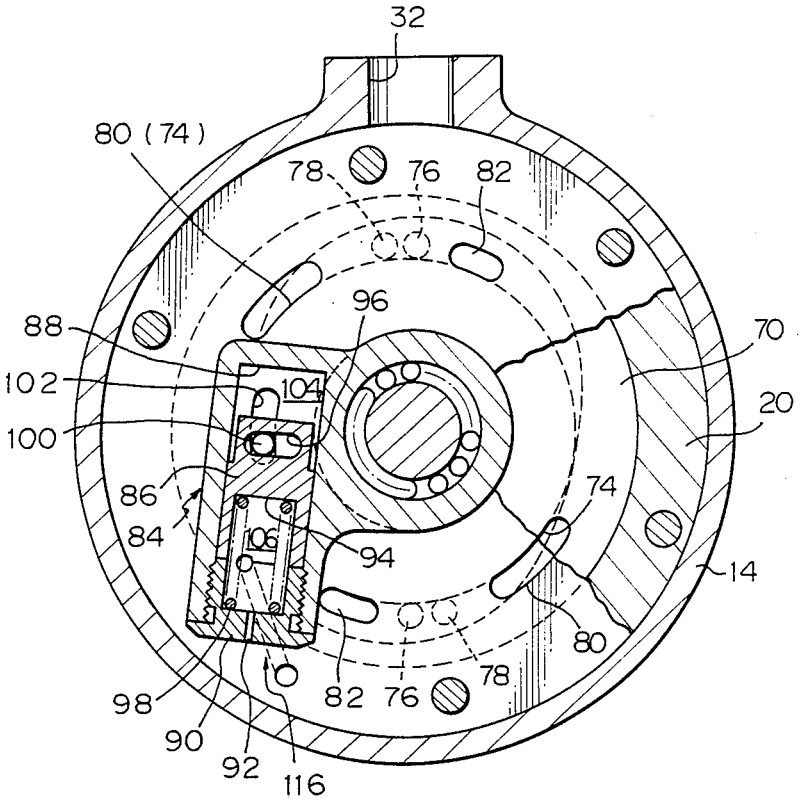
FIG. 3 is a cross sectional view taken along the line III—III of FIG. 1.

The annular plate member 70 has two elongated arcuate slots 74 formed therein which are diametrically and circumferentially disposed with respect to the axis of the annular plate member 70. As shown in FIG. 3, each of the arcuate slots 74 is opened into the corresponding crescent chamber 38 and is positioned in the vicinity of the narrow end thereof which the vanes 56 first meet when passing therethrough during the rotation of the rotor 36. It should be noted that the elongated arcuate slots 74 are longer than the width of the vanes 56.

The annular plate member 70 also has two sets of openings 76 and 78 formed therein which are also diametrically and circumferentially disposed with respect to the axis of the annular plate member. Each set of openings 76 and 78 are opened into the corresponding crescent chamber 38 and are positioned between the arcuate slot 74 thereof and the narrow end thereof which the vanes 56 later meet when passing therethrough during the rotation of the rotor 36. The two sets of openings 76 and 78 are preferably placed on the same circle as the two elongated arcuate slots 74.

Figure 6:
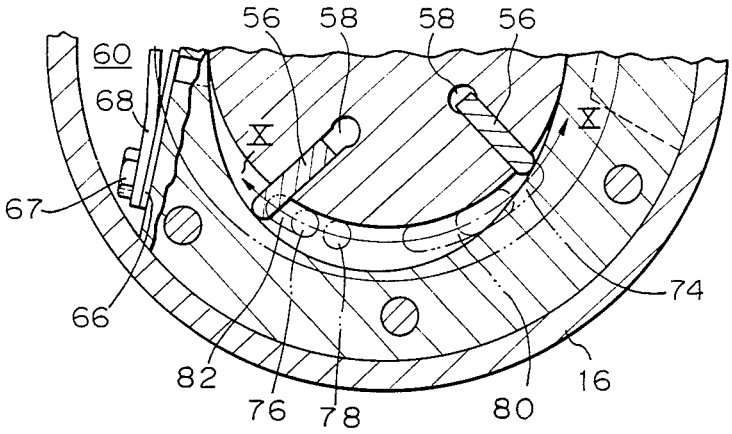
FIG. 6 is a half cross sectional view similar to FIG. 5 wherein the annular plate member is in an intermediate position between the first extreme position and a second extreme position thereof as shown in FIG. 7.

On the other hand, the end wall member 24 has two elongated arcuate slots 80 formed therein which have the same size and shape as the elongated arcuate slots 74 of the annular plate member 70, and which are disposed diametrically and circumferentially so that each of the arcuate slots 80 are aligned and registrated with the corresponding arcuate slot 74 of the annular plate member 70 when it is in the first position as shown in FIGS. 3 and 6. As seen from FIG. 1, the arcuate slots 80 of the end wall member 24 open into the suction chamber 24, thereby causing the refrigerant to be introduced from the suction chamber 24 into the crescent chambers 38.

It can be easily understood from the foregoing that the refrigerant introduced into the crescent chamber 38 through the registrated slots 74 and 80 is subjected to compression because the vanes 56 pass through the crescent chamber. More particularly, when any one of the vanes 56 advances along the length of the arcuate groove or slot 74 during its passage through the crescent chamber 38, this crescent chamber 38 is separated into two chamber sections, that is, the front and rear sections, by the vane in such a manner that the volume of the front chamber section is gradually decreased to compress the refrigerant included therein whereas the volume of the rearward chamber section is gradually increased to introduce the refrigerant from the suction chamber 28 thereinto. Strictly speaking, the compression stroke which is carried out at the front chamber section by the vane starts at the time when the vane reaches the point $P_1$ as shown in FIGS. 5 and 8. This is because a part of the refrigerant is allowed to escape from the front chamber section into the rear chamber section through the gap between the point $P_1$ and the vane, as shown by an arrow 83 in FIG. 8, until the vane reaches the point $P_1$.

In this case, it should be noted that the point at which the compression stroke starts can be varied by moving the annular plate member 70 between the first and second positions, as indicated by reference symbols $P_2$ and $P_3$ in FIGS. 6 and 10 and FIGS. 7 and 11, respectively, while an opening area which is defined by both slots 74 and 80 is gradually decreased by rotating the annular plate member 70 from the first position to the second position. In other words, in the embodiment as illustrated, the arrangement of both the slot 74 and the slot 80 constitutes means for varying the compression stroke and means for throttling the opening area through which the refrigerant is introduced into the crescent chamber.

Figure 9:
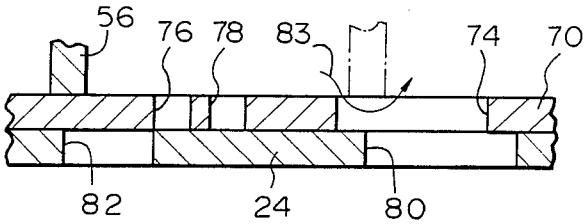
FIG. 9 is a sectional view similar to FIG. 8 wherein the annular plate member is in another of the intermediate positions.

The end wall member 24 also has arcuate slots 82 which are shorter than the arcuate slots 80. The shorter arcuate slots 82 are disposed diametrically and circumferentially so that each of the shorter slots 82 is substantially aligned and registrated with the corresponding set of the openings 76 and 78 of the annular plate member 70 when it is in the second position as shown in FIGS. 7 and 11. Particularly, while the annular plate member 70 is rotated from the first extreme position (FIG. 8) to an intermediate position as shown in FIG. 9, the openings 76 and 78 remain closed with respect to the arcuate slot 82. However, as the plate member 70 is further moved from the intermediate position (FIG. 9) toward the second extreme position (FIG. 11), the opening 76 first partly opens and ten completely opens into the slot 82 and thereafter the opening 78 partly and then completely opens thereinto. As seen from FIGS. 8 to 11, since the shorter arcuate slots 82 open into the suction chamber 28, a part or a substantial portion of the refrigerant under the compression stroke is positively allowed to escape from the front chamber section to the suction chamber 28 when the annular plate member 70 is placed between the intermediate position (FIG. 9) and the second position (FIG. 11).

In the illustrated embodiment, in order to rotate the annular plate member 70 between the first and second extreme positions, a hydraulic actuator 84 is used, as best shown in FIG. 3, in which the lubricant oil 31 is utilized as a working fluid. The actuator 84 includes a spool member 86 slidably received within a cylindrical bore 88 formed in the end wall member 24. An opening end of the cylindrical bore 88 is closed by means of a stopper element 90 having a restricted oil passage 92 formed at center thereof. The spool member 86 has a recess 94 formed at one end and a slot 96 formed at the other end. A compressed spring 98 is provided, which has a predetermined spring constant, between the recess end 94 of the spool member 86 and the inner end of the stopper 90 in which a recess is also formed. The slot end 96 receives a pin element 100 which is extended from the annular plate member 70 through an arcuate slot 102 formed in the end wall member 24.

As seen from FIG. 3, the spool member 86 divides the cylindrical bore into two chambers 104 and 106. The chamber 104 is in communication with the lubricant oil 31 received in the oil separating chamber 30. To this end, an annular oil groove 108 is formed in the end wall member 24 along the inner circumferential edge of the annular plate member 70. The annular oil groove 108 is communicated with the enlarged bottom portion of the grooves 58 for receiving the vanes 56 and is also communicated with the chamber 104 through an oil passage 110 which is formed in the end wall member 24 between the annular oil groove 108 and the chamber 104. Similarly, an annular oil groove 112 is formed in the end wall member 26 around the shaft 38. This annular oil groove 112 is communicated with the bottom portion of the grooves 58 for receiving the vanes 56 and is also communicated with the space 54 through the clearances which exist in the needle bearing 42. As shown in FIG. 1, the space 54 is in communication with the lubricant oil 31 through an oil passage 114 which is formed in the end wall member 26. In this way, the communication between the chamber 104 and the lubricant oil 31 is achieved. This communication system or oil passage system also serves as a lubrication system for lubricating the movable elements of the vane compressor 10.

Figure 4:
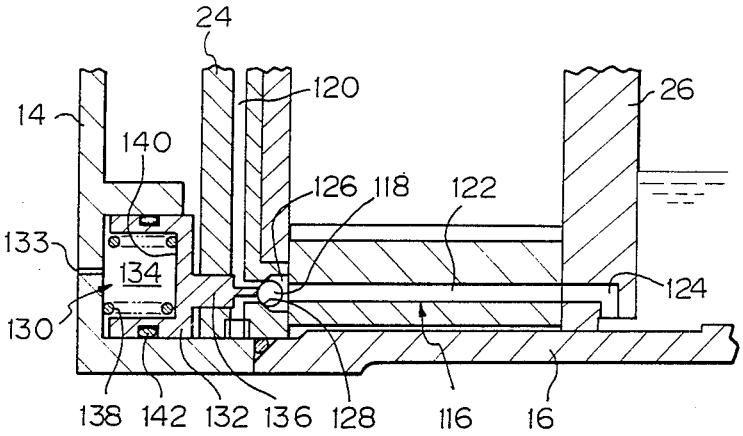
FIG. 4 is a partial sectional view showing a valve actuator used in the embodiment illustrated.

On the other hand, as shown in FIGS. 3 and 4, the chamber 106 can be communicated with the lubricant oil 31 by an oil passage 116 provided at one point with a spherical valve body 118. Particularly, the oil passage 116 includes a passage section 120 formed in the end wall member 24, a passage section 122 formed in the cylindrical body 20, and a passage section 124 formed in the end wall member 26. The spherical valve body 118 is disposed within an enlarged end space 126 of the passage section 120, which is connected to the passage section 122, and can be seated on a valve seat 128 formed on a bottom of the enlarged end space 126.

In order to actuate the valve body 20 in response to a pressure change of the refrigerant within the suction chamber 28 so as to control the actuator 84 for the annular plate member 70, a valve actuator 130 is provided within the suction chamber 28. The valve actuator 130 includes a piston member 132 which is received in a cylindrical bore 134 formed in the bottom of the suction chamber 28. The piston member 132 is exposed at its one end to the refrigerant within the suction chamber 28 and has a rod member 136 formed at the same end, which is fluid-tightly extended through the end wall member 24 and connected at the free end thereof to the spherical valve body 118. A compressed coil spring 138, which has a predetermined spring constant, is disposed within a cylindrical recess 140 formed at the other end of the piston member 132, wherein the ends of the coil spring 138 bear against the bottom of the bore 134 and the bottom of the recess 140, respectively. The piston member 132 has a seal ring 142 provided in a peripheral groove formed in the outer surface thereof. The cylindrical bore 134, which is closed by the piston member 132, is in communication with the atmosphere through a small passage 133 formed in the bottom of the bore 134.

The operations and advantages of the rotary vane compressor according to the present invention will now be explained in detail.

During the running of the vane compressor 10, if a cooling load at the air conditioning system is so high that the compressor must be run at the maximum cooling capacity, a pressure of the refrigerant within the suction chamber 28 is very high because a large amount of the refrigerant is fed to and evaporated in the evaporator of the air conditioning system to which the suction chamber 28 is adapted to be connected through the inlet port 32 thereof. Because of the very high pressure of the refrigerant created in the suction chamber 28, the piston member 140 of the valve actuator 130 is pushed into the cylindrical bore 134 against the spring force of the coil spring 138 so that the spherical valve body 118 is seated on the valve seat 128 to thereby close the oil passage 116. When the oil passage 116 is closed, only the chamber 104 is in communication with the lubricant oil 31 under the compressed refrigerant within the oil separating chamber 30. Therefore, the pressurized lubricant oil 31 is fed to the chamber 104 so that the spool member 84 is moved to one of the extreme positions against the spring force of the coil spring 98, whereby the annular plate member 70 is rotated to the first position as shown in FIGS. 5 and 8. As apparent from the foregoing, in the first position, each of the arcuate slots 74 of the annular plate member 70 is aligned and registrated with the corresponding arcuate slot 80 of the end wall member 24, so that it is possible to obtain the maximum compression stroke of the vanes 56 (that is, the compression stroke starts when the vane reaches the point $P_1$) and the maximum opening area for introducing the refrigerant from the suction chamber into the crescent or compressing chambers 38, whereby the rotary vane compressor 10 can be run at the maximum cooling capacity, that is, the maximum amount of the compressed refrigerant can be fed from the oil separating chamber 30 to the condensor of the air conditioning system.

The compressed refrigerant is discharged from the compressing chambers 38 into the discharging chambers 60 through the exits ports 64, with the reed valves 66 opened at the end of the compression stroke of the vanes 56 by a high pressure of the compressed refrigerant. The compressed refrigerant discharged into the chamber 60 may entrain a small quantity of lubricant oil as fine drops. The lubricant oil drops entrained by the compressed refrigerant are separated therefrom by ejection from the discharging chamber 60 through the relatively small hole 62 into the oil separating chamber 30 having a large volume, in the manner well known by those skilled in the art, so that the separated lubricant oil drops fall into the body 31 of the lubricant oil in the space and/or along he inner wall surfaces of the end wall member 26. The compressed refrigerant from which the lubricant oil is separated is fed to the condenser of the air conditioning system through the exit port 34 of the air separating chamber 30.

As the vane compressor 10 is continuously run at the maximum cooling capacity over a certain period, a room temperature of, for example, an automobile, may be gradually brought to a temperature at which a driver and passengers may feel comfortable under ambient conditions. As a result, the cooling load at the air conditioning system is gradually reduced so that the amount of the refrigerant which is evaporated in the evaporator of the air conditioning system is reduced thereby causing the refrigerant pressure of the suction chamber 28 to be lowered. The lowering of the refrigerant pressure causes the piston member 132 to be moved by the biasing force of the compressed coil spring 138 so that the valve body 118 is shifted away from the valve seat 128, whereby the chamber 106 of the actuator 84 is communicated with the pressurized lubricant oil 31. Thus, the lubricant oil is fed to the chamber 106 of the actuator 84 so that the spool member 86 is moved toward the chamber 104, whereby the annular plate member 70 may be rotated from the first extreme position (FIGS. 5 and 8) to the intermediate position as shown in FIG. 9. It should be noted that the movement of the spool member 86, and hence the movement of the annular plate member 70, is gradually and slowly carried out because a part of the lubricant oil which is being fed to the chamber 106 is gradually discharged through the restricted passage 92 into the suction chamber 28 and because a part of the lubricant oil with which the chamber 104 is filled is returned to the oil separating chamber 30. When the annular plate member 70 is moved from the first position to the intermediate position (FIG. 9), the compression stroke is somewhat shorter than in the first extreme position and the opening area for introducing the refrigerant from the suction chamber 28 into the crescent chambers 38 is slightly throttled, whereby the rotary vane compressor 10 can be run at a lower cooling capacity than the maximum cooling capacity.

Figure 10:
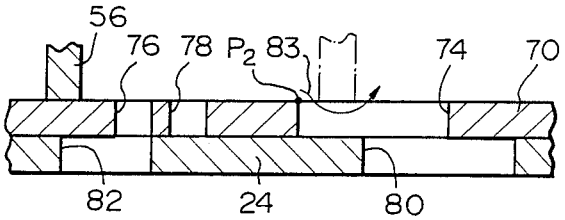
FIG. 10 is a sectional view taken along the lines X—X of FIG. 6.

Also, the annular plate member may be moved from the intermediate position (FIG. 9) to the second intermediate position as shown in FIGS. 6 and 10 due to the further lowering of the refrigerant pressure within the suction chamber 28. In this case, where the annular plate member is in the second intermediate position (FIGS. 6 and 10), and thus the compression stroke is further shortened (the compression stroke starts when the vane reaches the point $P_2$), the opening area for introducing the refrigerant from the suction chamber 28 into the crescent chambers 38 is further throttled and therefore, a part of the refrigerant which is being compressed in the forward section of the crescent chamber 38 is positively allowed to escape from the forward crescent chamber section into the suction chamber 28 through the opening 76 of the annular plate member 70 which opens into the arcuate slot 82 of the end wall member 24. Therefore, the amount of the compressed refrigerant which is fed from the oil separating chamber 30 to the air conditioning system is further reduced so that the vane compressor 10 can be run at a smaller cooling capacity than in the case as shown in FIG. 9.

Furthermore, the annular plate member 70 may be in the second extreme position as shown in FIGS. 7 and 11. In this second extreme position, both the openings 76 and 78 completely open into the arcuate slot 82 so that a substantial part of the refrigerant which is being compressed in the forward section of the crescent chamber 38 is allowed to escape into the suction chamber 28 through the openings 76 and 78. On the other hand, the opening area for introducing the refrigerant from the suction chamber 28 into the crescent chamber 38 is throttled to the maximum amount and the opening area is at the smallest opening, while the compression stroke is made shortest (in this case, the compression stroke may start when the vane reaches the point Q rather than the point $P_3$). Accordingly, when the annular plate member 70 is in the second extreme position (FIGS. 7 and 11), the amount of compressed refrigerant which is fed from the oil separating chamber 30 to the air conditioning system is minimized so that the rotary vane compressor 10 can be run at the minimum cooling capacity.

It can be easily understood that the annular plate member 70 may be stopped at one of the first and second extreme positions or at any intermediate position therebetween, depending upon ambient conditions, especially, an ambient temperature by which a cooling load at the air conditioning system is mainly determined. However, if the cooling load is increased by, for example, opening a door of an automobile, the annular plate member 70 is moved from a stopped position toward the first extreme position so that the vane compressor 10 is run at a larger cooling capacity and thereafter the annular plate member 70 is again returned to the stopped position.

Another embodiment of the present invention is shown in FIGS. 12 through 15, which correspond to FIGS. 8 through 11, respectively. This second embodiment is essentially identical with the first embodiment except that a distance $W_1$ (FIG. 12) between openings 76' and 78' which correspond to the openings 76 and 78, respectively, is wider than the distance therebetween and that two separate openings 144 and 146 are formed in the end wall member 24 in place of the arcuate slot 82 and are adapted to be associated with the openings 76' and 78', respectively. A distance $W_2$ (FIG. 12) between the openings 144 and 146 is equal to the distance $W_1$ and a width of the opening 146 is twice as long as a width of the opening 144 which is equal to that of the openings 76' and 78'. As seen from FIG. 12, in the first extreme position, the arcuate slots 74 and 80 are aligned and registrated with each other and the openings 144 and 146 are completely closed. Thus, the compressor can be run at the maximum cooling capacity, as in the first embodiment. As the annular plate member 70 moves from the first extreme position (FIG. 12) toward the first intermediate position (FIG. 13), the opening area defined by the arcuate slots 74 and 80 for introducing the refrigerant into the crescent chamber 38 is further throttled, and simultaneously, the compression stroke carried out by the vane is made shorter, with the openings 76′ and 78′ still remaining closed. When the annular plate member 70 is moved from the first intermediate position (FIG. 13) through the second intermediate position (FIG. 14) to the second extreme position (FIG. 15), the opening 78′ first opens into the associated opening 146 and then the opening 144 opens into the associated opening 144, with the opening area defined by the arcuate slots 74 and 80 being further throttled and the compression stroke being further shortened. Accordingly, the compressor according to the second embodiment is run in substantially the same manner as in the first embodiment, but in comparison with the first embodiment, the compressor of the second embodiment can be run within a wider range from the maximum cooling capacity to the minimum cooling capacity.

In the embodiments mentioned above, both the means for varying the compression stroke and the means for throttling the opening area through which the refrigerant is introduced into the crescent chamber are formed by the arcuate slots 74 and 80, which cooperate with each other. This arrangement is preferable because the compressor can be thus compactly constructed. Nevertheless, the means for varying the compression stroke and hhe means for throttling the opening area may be separately formed. In this case, a groove is formed in only the inner surface of the annular plate member in place of the slot 74. This groove forms the only means for varying the compression stroke. On the other hand, it is possible to use, as the throttling means, a throttling valve assembly, for example, as disclosed in Japanese Unexamined Patent Publication No. 59-99089.

Also, in the embodiments as mentioned above, the arcuate slot 74 may be longer than the arcuate slot 80 so that the compression stroke starts later.

Furthermore, the mechanical connection between the spool 86 and the annular plate member 70 may be attained by the use of a rack/pinion mechanism.

Furthermore, in place of the hydraulic actuator 84, there may be used an electric stepping motor which is constructed so as to be controlled by detecting a refrigerant pressure within the suction chamber 28 or a room temperature of an automobile. Of course, use of the hydraulic actuator 84 is preferable because of the desired compact construction of the compressor.

According to the present invention, it is possible to ensure a low cooling capacity running of the compressor at both the low speed operation and the high speed operation because the low cooling capacity running is attainable by positively allowing the escape of a part or a substantial portion of the compressed refrigerant from the front crescent chamber section through the opening or openings into the suction chamber whenever the compressor is required to be run at the low cooling capacity.

According to the invention, since it is unnecessary to run the compressor at a cooling capacity higher than that required to attain a comfortable temperature, it is possible to minimize a load at the engine of an automobile imposed by the air conditioning system.

According to the present invention, when the compressor is stopped, pressures within the oil separating chamber 30 and within the crescent chambers 38 are reduced to the pressure within the suction chamber 28 so that the spool 86 is completely moved toward the chamber 104 whereby the annular plate member 70 is in the first extreme position. Accordingly, since the compressor is initially run at the minimum cooling capacity, it is possible to carry out the initial running without applying an impact load to the engine of an automobile.

It is further understood by those skilled in the art that the foregoing description is a preferred embodiment of the disclosed device and that various changes and modifications may be made in the invention without departing from the spirit and scope thereof.

We claim:

1. A variable displacement vane compressor for an air conditioning system used in a vehicle such as an automobile, which comprises:

a housing (12) having opposed end walls;

a cylinder assembly (18) including a cylindrical body (20) having a bore (22) and first and second end wall members (24, 26) secured to the opposed ends of said cylindrical body (20), respectively, for closing open ends of said bore (22), said cylinder assembly (18) being housed within said housing (12) so that first and second chamber (28, 30 are formed between said first and second end wall member (24, 26) and the opposed end wall of said housing (12), respectively, said first and second chamber (28), 30) being in communication with an evaporator and a condenser of the air conditioning system, respectively;

a rotor (36) disposed within said bore (22) for rotation so as to form at least one crescent chamber (38) between said rotor (36) and the bore (22) of said cylinder assembly (18), said rotor (36) having at least a vane (56) which is extendably fitted in said rotor (36) so that the free end of said vane (56) is in contact with the circumferential inner wall surface of said bore (22) during the rotation of said rotor (36);

an annular plate member (70) disposed between the first end wall member (24) and the associated end portion of said cylindrical body (20) and being partially rotatable between first and second positions;

said first end wall member (24) having an elongated arcuate slot (80) formed therein in the vicinity of one of the narrow ends of said crescent chamber which said vane (56) first passes when passing through said crescent chamber (38) during the rotation of said rotor (36), said annular plate member (70) having an elongated arcuate slot (74) formed therein and being arranged so that said slot (74) is fully opened to the elongated arcuate slot (80) of said first end wall member (24) when said annular plate member (70) is positioned at said first position, and that as said annular plate member (70) is rotated from said first position toward said second position, an opening area of the elongated arcuate slot (74) of said annular plate member (70) with respect to the elongated arcuate slot (80) of said first end wall member (24) is gradually reduced, whereby when said annular plate member (70) is positioned at said first position, a maximum amount of refrigerant is introduced from said first chamber (38) into said crescent chamber (38) through both said elongated arcuate slots (80, 74) and is then compressed by said vane (56) during the passage thereof through said crescent chamber (38), and whereby when said annular plate member (70) is positioned at said second position, a minimum amount of refrigerant is introduced from said first chamber (38) into said crescent chamber (38) through both said elongated arcuate slots (80, 74)

and is then compressed by said vane (56) during the passage thereof through said crescent chamber (38);

said cylindrical body having an exit port formed therein at the other of the narrow ends of said crescent chamber (38) which said vane (56) later passes when passing through said crescent chamber (38) during the rotation of said rotor (36), said exit port being opened into said crescent chamber (38) for discharging the compressed refrigerant from said crescent chamber (38) into said second chamber (30) through said exit port (64);

the elongated arcuate slot (74) of said annular plate member (70) having a length longer than a width of said vane (56) so that when said vane (56), by which said crescent chamber is divided into the front chamber section and the rear chamber section, sweeps over the elongated arcuate slot (74) of said annular plate member (70), a part of the introduced refrigerant is bypassed from said front chamber section to said rear chamber section;

said annular plate member (70) also having at least two opening (76', 78') which are formed therein between the other of said narrow ends of said crescent chamber and said elongated arcuate slot (74), said first end wall member (24) having at least two openings (144, 146), which are formed therein so as to cooperate with the at least two openings (76', 78') of said annular plate member (70) in such a manner that when said annular plate member (70) is in said first position, the at least two openings (76', 78') of said annular plate member (70) are in complete misalignment with the at least two openings (144, 146) of said first end wall member (24) to completely close the at least two openings (76', 78') of said annular plate member (70), that when said annular plate member (70) is in an intermediate position between said first and second positions, one (78') of the at least two openings (76', 78') of said annular plate member (70) is in alignment with one (146) of the at least two openings (144, 146) of said first end wall member (24) to allow a part of the compressed refrigerant to escape from the front chamber section of said crescent chamber (38) into said first chamber (28), and that when said annular plate, member (70) is in said second position, the at least two openings (76', 78') of said annular plate member (70) are in complete alignment with the at least two openings (144, 146) of said first end wall member (24) to obtain a maximum rate of escape of the compressed refrigerant from the front chamber section of said crescent chamber (38) into said first chamber (28), the opening (146) in the first end wall member (24), in alignment with one (78') of the at least two openings of the annular plate member is of sufficient size to be in alignment with the one (78') of the at least two openings of the annular plate member when the annular plate member is in the second position the at least two openings (76', 78') of said annular plate member (70) each being substantially equal to or smaller than the width of said vane (56) so that when said vane (56) sweeps over the at least two openings (76', 78') of said annular plate member (70), the compressed refrigerant is prevented from escaping from the front chamber section of said crescent chamber (38) to the rear chamber section thereof; and a drive means for moving said annular plate member (70) between said first and second positions in response to a change of a cooling load of the air conditioning system.

2. A variable displacement vane compressor set forth in claim 1, wherein said drive means includes a hydraulic actuator in which the lubricant oil used in said compressor is utilized as a working fluid, said hydraulic actuator being operated in response to a pressure change of the refrigerant which is returned from said air conditioning system to said compressor for compression.

3. A variable displacement vane compressor set forth in claim 2, wherein said hydraulic actuator includes a spool member movably received within a cylindrical bore, the spool member dividing said cylindrical bore into two chambers which are communicated with a reservoir for the lubricant oil under pressure through two separate oil passages, respectively, and wherein there is provided a control means for controlling said hydraulic actuator and said control means includes a valve means provided in on of said oil passages, and a valve actuator for operating said valve means, said valve actuator including a piston member having one end exposed to a pressure of the refrigerant returned from said air conditioning system to the compressor whereby said valve means in capable of being operated in response to a change of the refrigerant pressure.

4. A variable displacement vane compressor for an air conditioning system used in a vehicle such as an automobile, which comprises:

a housing (12) having opposed end walls;

a cylinder assembly (18) including a cylindrical body (20) having a bore (22) and first and second end wall member (24, 26) secured to the opposed ends of said cylindrical body (20), respectively, for closing open ends of said bore (22), said cylinder assembly (18) being housed within said housing (12) so that a first and second chamber (28, 30) are formed between said first and second end wall members (24, 26) and the opposed end walls of said housing (12), respectively, said first and second chambers (28<30 being in communication with an evaporator and a condenser of the air conditioning system, respectively;

a rotor (36) disposed within said bore (22) for rotation so as to form at least one crescent chamber (38) between said rotor (36) and the bore (22) of said cylinder assembly (18), said rotor (36) having at least a vane (56) which is extendably fitted in said rotor (36) so that the free end of said vane (56) is in contact with the circumferential inner wall surface of said bore (22) during the rotation of said rotor (36);

an annular plate member (70) disposed between the first end wall member (24) and the associated end portion of said cylindrical body (20) and being partially rotatable between first and second positions;

said first end wall member (24) having an elongated arcuate slot (80) formed therein in the vicinity of one of the narrow ends of said crescent chamber (38) which said vane (56) passes when passing through said crescent chamber (38) during the rotation of said rotor (36), said annular plate member (70) having an elongated arcuate slot (74) formed therein and being arranged so that the slot (74) formed therein and being arranged so that the slot (74) is fully opened to the elongated arcuate slot (80) of said first end wall member (24) when said annular plate member (70) is positioned at said first position, and that as said annular plate member (70) is rotated from said first position toward said second position, and opening area of the elongated arcuate slot (74) of said annular plate member (70) with respect to the elongated arcuate slot (80) of said first end wall member (24) is gradually reduced, whereby when said annular plate member (70) is positioned at said first position, a maximum amount of refrigerant is introduced from said first chamber (38) into said crescent chamber (38) through both said elongated arcuate slots (80, 74) and is then compressed by said vane (56) during the passage thereof through said crescent chamber (38), and whereby when said annular plate member (70) is positioned at said second position, a minimum amount of refrigerant is introduced from said first chamber (38) into said crescent chamber (38) through both said elongated slots (80, 74) and is then compressed by said vane (56) during the passage thereof through said crescent chamber (38);

said cylindrical body having an exit port formed therein at the other of the narrow ends of said crescent chamber (38) which said vane (56) latter passes when passing through said crescent chamber (38) during the rotation of said rotor (36), said exit port being opened into said crescent chamber (38) into said second chamber (30) through said exit port (64);

the elongated arcuate slot (74) of said annular plate member (70) having a length longer than a width of said vane (56) so that when said vane (56), by which said crescent chamber is divided into the front chamber section and the rear chamber section, sweeps over the elongated arcuate slot (74) of said annular plate member (70), a part of the introduced refrigerant is bypassed from said front chamber section to said rear chamber section;

said annular plate member (70) also having at least two openings (76, 78) which are formed therein between the other of said narrow ends of said crescent chamber and said elongated arcuate slot (74), said first end wall member (24) having an elongated arcuate opening (82) which are formed therein so as to cooperate with the at least two openings (76, 78) of said annular plate member (70) in such a manner that when said annular plate member (70) is in said first position, the at least two openings (76, 78) of said annular plate member (70) remain closed with respect to the elongated arcuate opening (82), that when said annular plate member (70) is in an intermediate position between said first and second positions, one (76) of the at least two openings (76, 78) of said annular plate member (70) opens into the elongated arcuate opening (82) of said first end wall member (24) to allow a part of the compressed refrigerant to escape from the front chamber section of said crescent chamber (38) into said first chamber (28), and that when said annular plate member (70) is in said second position, the at least two openings (76, 78) of said annular plate member (70) completely open into the elongated arcuate opening (82) of said first end wall member (24) to obtain a maximum rate of escape of the compressed refrigerant from the front chamber section of said crescent chamber (38) into said first chamber (28), the at least two openings (76, 78) of said annular plate member (70) each being substantially equal to or smaller than by the width of said vane (56) so that when said vane (56) sweeps over the at least two openings (76, 78) of said annular plate member (70), the compressed refrigerant is prevented from escaping from the front chamber section of said crescent chamber (38) to the rear chamber section thereof; and a drive means for moving said annular plate member (70) between said first and second positions in response to a change of a cooling load at the air conditioning system.

* * * * *